US012331757B2

(12) United States Patent
Pittroff

(10) Patent No.: US 12,331,757 B2
(45) Date of Patent: Jun. 17, 2025

(54) CENTRIFUGAL PUMP FOR CONVEYING MEDIA CONTAINING SOLIDS

(71) Applicant: KSB SE & Co. KGaA, Frankenthal (DE)

(72) Inventor: Markus Pittroff, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 63 days.

(21) Appl. No.: 18/012,794

(22) PCT Filed: Jun. 23, 2021

(86) PCT No.: PCT/EP2021/067138
§ 371 (c)(1),
(2) Date: Dec. 23, 2022

(87) PCT Pub. No.: WO2021/260000
PCT Pub. Date: Dec. 30, 2021

(65) Prior Publication Data
US 2023/0258187 A1 Aug. 17, 2023

(30) Foreign Application Priority Data
Jun. 26, 2020 (DE) ..... 10 2020 003 855.7

(51) Int. Cl.
*F04D 7/04* (2006.01)
*F04D 29/02* (2006.01)
(Continued)

(52) U.S. Cl.
CPC ..... *F04D 7/04* (2013.01); *F04D 29/426* (2013.01)

(58) Field of Classification Search
CPC ..... F04D 29/167; F04D 7/04; F04D 29/026; F04D 29/086; F04D 29/126;
(Continued)

(56) References Cited

U.S. PATENT DOCUMENTS 3,025,070 A * 3/1962 Copes ..... F16J 15/38 277/408
4,867,638 A * 9/1989 Handtmann ..... F16J 15/44 415/217.1
(Continued)

FOREIGN PATENT DOCUMENTS

DE 2 051 011 A1 4/1972
DE 35 13 116 A1 10/1986
(Continued)

OTHER PUBLICATIONS

Machine Translation of WO 2019229131 A1 [retrieved on Apr. 23, 2024]. Retrieved from: Espacenet. (Year: 2024).*
(Continued)

*Primary Examiner* — Eric J Zamora Alvarez
(74) *Attorney, Agent, or Firm* — Crowell & Moring LLP

(57) ABSTRACT

A centrifugal pump for conveying media containing solids includes at least one arrangement for reducing a backflow from a first chamber into a second chamber. The at least one arrangement includes at least one non-rotating element that cooperates with at least one rotating counter element. At least one of the at least one non-rotating element and the at least one rotating element I coated at least in parts by a tetrahedral hydrogen-free amorphous carbon layer.

14 Claims, 5 Drawing Sheets

(51) Int. Cl.

| | |
|---|---|
| ***F04D 29/16*** | (2006.01) |
| ***F04D 29/22*** | (2006.01) |
| ***F04D 29/42*** | (2006.01) |

(58) Field of Classification Search
CPC .. F04D 29/2294; F04D 29/426; F04D 29/622; F04D 29/628; F05D 2300/224; F05D 2230/90; F05D 2300/611; F05D 2300/10; F05D 2300/604; F16C 33/043; F16C 33/74; F01D 1/02
See application file for complete search history.

(56) References Cited

U.S. PATENT DOCUMENTS

| | | | | |
|---|---|---|---|---|
| 9,677,560 | B1 | 6/2017 | Davis et al. | |
| 2007/0071907 | A1 | 3/2007 | Stiles et al. | |
| 2018/0112711 | A1* | 4/2018 | Itadani | C23C 16/26 |
| 2018/0372226 | A1* | 12/2018 | Hauske | F16J 15/3492 |
| 2019/0390686 | A1* | 12/2019 | Will | F04D 29/426 |

FOREIGN PATENT DOCUMENTS

| | | | | |
|---|---|---|---|---|
| DE | 37 08 956 | C1 | 3/1988 | |
| DE | 10 2012 218 861 | A1 | 4/2014 | |
| DE | 10 2017 223 602 | A1 | 8/2019 | |
| DE | 10 2018 214 650 | A1 | 3/2020 | |
| KR | 10-1670230 | B1 | 11/2016 | |
| WO | WO 2019/120975 | A1 | 6/2019 | |
| WO | WO-2019229131 | A1 * | 12/2019 | F04D 29/026 |

OTHER PUBLICATIONS

International Search Report (PCT/ISA/210) issued in PCT Application No. PCT/EP2021/067138 dated Sep. 24, 2021 with English translation (seven (7) pages).
German-language Written Opinion (PCT/ISA/237) issued in PCT Application No. PCT/EP2021/067138 dated Sep. 24, 2021 (six (6) pages).
German-language Search Report issued in German Application No. 10 2020 003 855.7 dated Jun. 22, 2021 with partial English translation (13 pages).

* cited by examiner

CENTRIFUGAL PUMP FOR CONVEYING MEDIA CONTAINING SOLIDS

CROSS REFERENCE TO RELATED APPLICATION

This application claims priority under 35 U.S.C. § 119 from German Patent Application No. 102020003855.7, filed Jun. 26, 2020, the entire disclosure of which is herein expressly incorporated by reference.

BACKGROUND AND SUMMARY OF THE INVENTION

The invention relates to a centrifugal pump for conveying of solids-containing media having an arrangement for reduction of backflow from a first space into a second space.

Centrifugal pumps have gaps through which fluid is possible at various points, for example between the impeller and the housing, where a pressure difference causes a leakage flow which results in very high loss in some cases. The seal here must be chosen with regard to the order of size of the gap such that it is neither too large, such that the efficiency of the centrifugal pump falls as a result of high losses through this gap, nor may the gap be too small, because there is otherwise the risk of encroachment, i.e. contact between the rotating component and the stationary component.

Such a seal may, for example, be a split ring seal arrangement. Split ring seal arrangements in centrifugal pumps serve to seal spaces at different pressures. The arrangement comprises a nonrotating element and a rotating element. The nonrotating element may, for example, be a split ring disposed on the housing, or the housing itself or a housing part. The rotating element may, for example, be a race disposed on the impeller, or the impeller itself or part of the impeller, for example the cover plate of the impeller in the case of a closed impeller.

The gap formed between the rotating element and the nonrotating element acts as a throttle between the spaces at different pressures and prevents an excessive flow from the space at higher pressure to the space at lower pressure. The smaller the gap between the two elements, the smaller the losses of efficiency of the centrifugal pump. However, this effort is opposed by the fact that too small a gap is very difficult to reconcile with the manufacturing tolerances and the operating influences. The aim is to avoid contact between the elements in order to prevent rubbing of the rotating element against the nonrotating element and hence to preclude wear. On account of the necessary tolerances in the production of the individual components, there is a minimum gap width which just prevents contact between elements, thus resulting in friction and wear. However, in operation, especially in the startup or shutdown of the pump, situations occur time and again in which there is contact and then occurrence of compression or material wear.

In the case of conveying of solids-containing media, moreover, widening of the gap caused by the abrasive action of the soil particles has to be expected. Thus, particularly in the case of centrifugal foul water pumps, a rising loss of efficiency has to be expected.

One example of a solids-containing medium is wastewater, especially communal and industrial wastewater. This generally includes untreated wastewater (e.g. foul water, feces), wastewater (mechanically cleaned water from sedimentation tanks), sludge (e.g. activated sludge, fresh sludge, effluent and seeding sludge) and rainwater. Industrial wastewater can under some circumstances be very corrosive or abrasive on the centrifugal pumps used, especially the media-contacting components of the centrifugal pump.

In order to take account of constant wear to the gap seal in centrifugal pumps for conveying of abrasive fluids, there has already been a proposal to provide a means of readjusting the gap by means of adjustable sealing elements. DE 35 13 116 A1 describes such a gap seal. A manually adjustable gap seal is comparatively complex in its production and requires a lot of experience from the operating personnel using it. The adjustment, monitoring and readjustment of the sealing elements in good time requires a comparatively high level of time and effort.

It is generally the case that cast components are frequently used in centrifugal pumps. Casting forms a solid body in the desired shape from a liquid material after solidification. Thus, it is specifically possible to produce the desired housing structures or impellers or other components of the centrifugal pump. Cast materials in centrifugal pump construction are generally iron-carbon alloys.

DE 10 2017 223 602 A1 specifies a split ring-race pair in a centrifugal pump based on silicon carbide. The hardness of the material is supposed to protect the centrifugal pump from abrasive wear. For this purpose, a ceramic element made of silicon carbide is inserted into a casting mold and then cast with a metallic casting material.

DE 10 2018 214 650 A1 describes a split ring seal of a centrifugal pump based on calcium carbonate in the aragonite modification, which, with a high hardness, is more wear-resistant to abrasive substances.

Especially in the case of centrifugal pumps that are used for conveying of solids-containing media, there are corrosion and wear phenomena in the region of the split ring seal. Owing to the high brittleness of most abrasion-resistant ceramic materials, the ceramic solutions proposed, in the case of particular component geometries, are generally very costly and inconvenient in their implementation, and can under some circumstances (for example as a result of parts breaking away) lead to disrupted operation.

It is an object of the invention to specify a centrifugal pump for conveying of solids-containing media. Damage to split rings by abrasive wear is to be effectively reduced. Furthermore, the pump should maintain its efficiency in operation for long periods. The centrifugal pump is to feature high reliability and a long lifetime. It is additionally to assure simple assembly. Furthermore, the centrifugal pump is to be a convincing solution by virtue of very low production costs.

This object is achieved in accordance with the invention by a centrifugal pump for conveying of solids-containing media having the features of the independent claim. Preferred variants can be inferred from the dependent claims, the description and the figures.

According to the invention, a centrifugal pump for conveying of solids-containing media has at least one arrangement for reduction of backflow through a nonrotating element that at least partly has a layer of carbon.

According to the invention, such an arrangement for reduction of backflow can be configured as a split seal which may be formed by a split ring and a race or by a split ring and an impeller. This arrangement serves to seal spaces at different pressures and acts as a throttle between the spaces. In this arrangement, a first space is understood to mean a space at higher pressure and a second space to mean a space at lower pressure. In the centrifugal pump, accordingly, the space at higher pressure is the space in the pressure port and the spiral housing. The space at lower pressure is the space in the suction region upstream of the impeller.

The split ring is arranged on the pump housing by means of a press fit and is correspondingly fixed and nonrotating. The split ring as such is disposed directly on the pump housing. In addition, it forms a gap with a rotating counterpart element. The rotating element may, for example, be a race on which the impeller is disposed, or the impeller itself or part of the impeller, for example a radial and/or axial surface of the top cover of the impeller in the case of a closed impeller.

Advantageously, the split ring has a carbon layer on a radial surface, for example the inside of the split ring, and/or on an axial surface, for example the end face of the split ring. This results in an enormous increase in the hardness of a standard split ring made of a cast material and/or a stainless steel material. The split ring thus receives effective protection against the abrasive action of solid particles in the conveying medium.

The carbon layer is particularly advantageous with regard to contact with or encroachment of the counterpart element. Owing to the particularly smooth surface of the carbon layer and its unusual hardness, the split ring is insensitive with respect to rubbing action by a counterpart element.

In one variant of the invention, a second split ring is used for sealing of the impeller against the bearing support cap. This split ring also has a carbon layer that protects the split ring particularly against the abrasive action of solids-containing media and unwanted contact with the impeller.

According to the invention, the split ring interacts with a counterpart element in order to prevent a particularly small gap for reduction of backflow from a space at higher pressure to a space of lower pressure in the pump. This counterpart element may be configured in the form of a race disposed on a prepared surface of the cover plate of the impeller. In an alternative variant, the counterpart element may take the form of a worked radial and/or axial surface of the cover plate of the impeller. In both variants, according to the invention, a carbon layer has been applied to the gap-forming surfaces. Ideally, this protects the rotating counterpart element from the abrasive action of the solids-containing medium.

A particularly advantageous configuration of split rings is from standard metallic materials, especially cast materials and/or stainless steel materials, which are then coated with a particularly hard carbon layer that provides protection from abrasion. In this way, it is possible to produce split rings from an inexpensive raw material that can simultaneously be worked by standard manufacturing methods.

Carbon layers are understood to mean layers in which carbon is the predominant constituent. The carbon layer may be applied, for example, by a PVD (Physical Vapor Deposition), a physical gas phase deposition, for instance by evaporation or sputtering) or a CVD (Chemical Vapor Deposition) method.

The carbon layer is preferably an amorphous carbon layer, especially a tetrahedral hydrogen-free amorphous carbon layer, which is also referred to as a ta-C layer. The atomic bonds belonging to the crystal lattice of graphite (a total of 3 in each case) are identified by the "sp2" designation. The hybridization here is sp2 hybridization.

In the case of a diamond layer, each carbon atom forms a tetrahedral arrangement with four adjacent atoms. In this spatial arrangement, all the atomic distances are equally short. Therefore, very high bonding forces act between the atoms, and in all spatial directions. This results in the high strength and extreme hardness of diamond. The atomic bonds belonging to the crystal lattice of diamonds, a total of four in each case, are identified by the designation "sp3". The hybridization is thus sp3 hybridization.

In a particularly favorable variant of the invention, the carbon layer consists of a mixture of sp3- and sp2-hybridized carbon. This layer is characterized by an amorphous structure. It is also possible for extraneous atoms such as hydrogen, silicon, tungsten or fluorine to be incorporated into this carbon network.

The inventive arrangement of a carbon layer on a split ring and on a counterpart element, for example a race, leads to a considerable reduction in abrasive wear.

The arrangement of a carbon layer on a split ring creates an extremely smooth axial surface with antistick properties without any need for complex mechanical reworking of the impeller. In addition, it is possible for multiple split rings to be introduced in a coating reactor, preferably executed as a vacuum chamber, where the ta-C coating is applied under moderate thermal stress. Thus, the centrifugal pump of the invention with at least one split ring is notable for comparatively low production costs.

In a particularly favorable variant of the invention, the carbon layer is applied as a coating of a split ring. The thickness of the layer is advantageously more than 0.5 μm, preferably more than 1.0 μm, especially more than 1.5 μm. In addition, it is found to be favorable when the carbon layer is less than 18 μm, preferably less than 16 μm, especially less than 14 μm.

Ideally, the coating of carbon has an extremely smooth axial surface with antistick properties, in which the average roughness volume Ra of the carbon layer is less than 0.7 μm, preferably less than 0.5 μm, especially less than 0.3 μm.

The ta-C coating has a very low coefficient of friction coupled with very good chemical stability. The hardness of the coating comes close to the hardness of diamonds, with the hardness preferably being more than 20 GPa, preferably more than 30 GPa, especially more than 40 GPa, and less than 120 GPa, preferably less than 110 GPa, especially less than 100 GPa.

With an average of 40 to 75 GPa, ta-C coatings are harder than a-C: H layers. In addition, ta-C does not contain any hydrogen. Therefore, it can be assumed that ta-C on contact with water (at temperatures above 80° C.) will be more stable than a-C: H. In contact with other liquids-especially polar liquids-containing molecules incorporating hydrogen, ta-C could likewise have better stability than a-C: H.

Preferably, the carbon layer is not applied directly to a split ring; instead, an adhesion promoter layer is provided first. This preferably consists of a material that both has good adhesion to steel and prevents diffusion of carbon, for example through the formation of stable carbides. Adhesion promoter layers used that meet these demands appropriately include thin layers of chromium, titanium or silicon. In particular, chromium carbide and tungsten carbide have been found to be useful adhesion promoters.

In an advantageous variant of the invention, the coating has an adhesion promoter layer that preferably includes a chromium material. The adhesion promoter layer preferably consists to an extent of more than 30% by weight, preferably more than 60% by weight, especially more than 90% by weight, of chromium.

The ta-C coating of the invention is a simple, readily achievable and economically viable coating for split rings in centrifugal pumps. The coating of the invention, as well as very high hardness, also has excellent sliding properties and good chemical stability. In particular, most metallic materials feature higher ductility by direct comparison with a ceramic material.

The reason for the advantage of the higher hardness resulting from the ta-C coating is that small and large solid particles that are often present in the solids-containing media can now have a significantly reduced abrasive effect on the split seal, i.e. the split ring and a counterpart element. The flow causes these solid particles normally to act like an abrasive. Split ring, race, impellers and/or housing parts of the suction side that are coated with ta-C have an extremely hard protective layer against abrasion, which distinctly increases the period of use thereof in the conveying of solids-containing media.

For the coating, PECVD/PACVD methods may be used with preference. Plasma excitation of the gas phase is effected here by the introduction of pulsed DC, or mid-frequency (kHz range) or high-frequency (MHz range) power. For reasons of maximized process variability with different workpiece geometries and loading densities, the introduction of pulsed DC has additionally been found to be useful.

Ideally, PVD methods are used for the coating. These methods are particularly simple and have a low process temperature. This technology leads to layers into which extraneous atoms may also be incorporated if required. The process regime is preferably effected in such a way that changes in microstructure and dimensions of the materials to be coated (metallic, gray iron, etc.) are ruled out.

The ta-C coating has the advantage over a CVD diamond layer that the coating temperature for CVD diamond layers is 600 to 1000° C., and that for amorphous carbon layers such as ta-C is well below 500° C. This is of high technical relevance particularly for the coating of metallic materials. The production of PVD diamond layers is impossible.

Further features and advantages of the invention will be apparent from the description of working examples with reference to the drawings, and from the drawings themselves.

DETAILED DESCRIPTION

Figure 1:
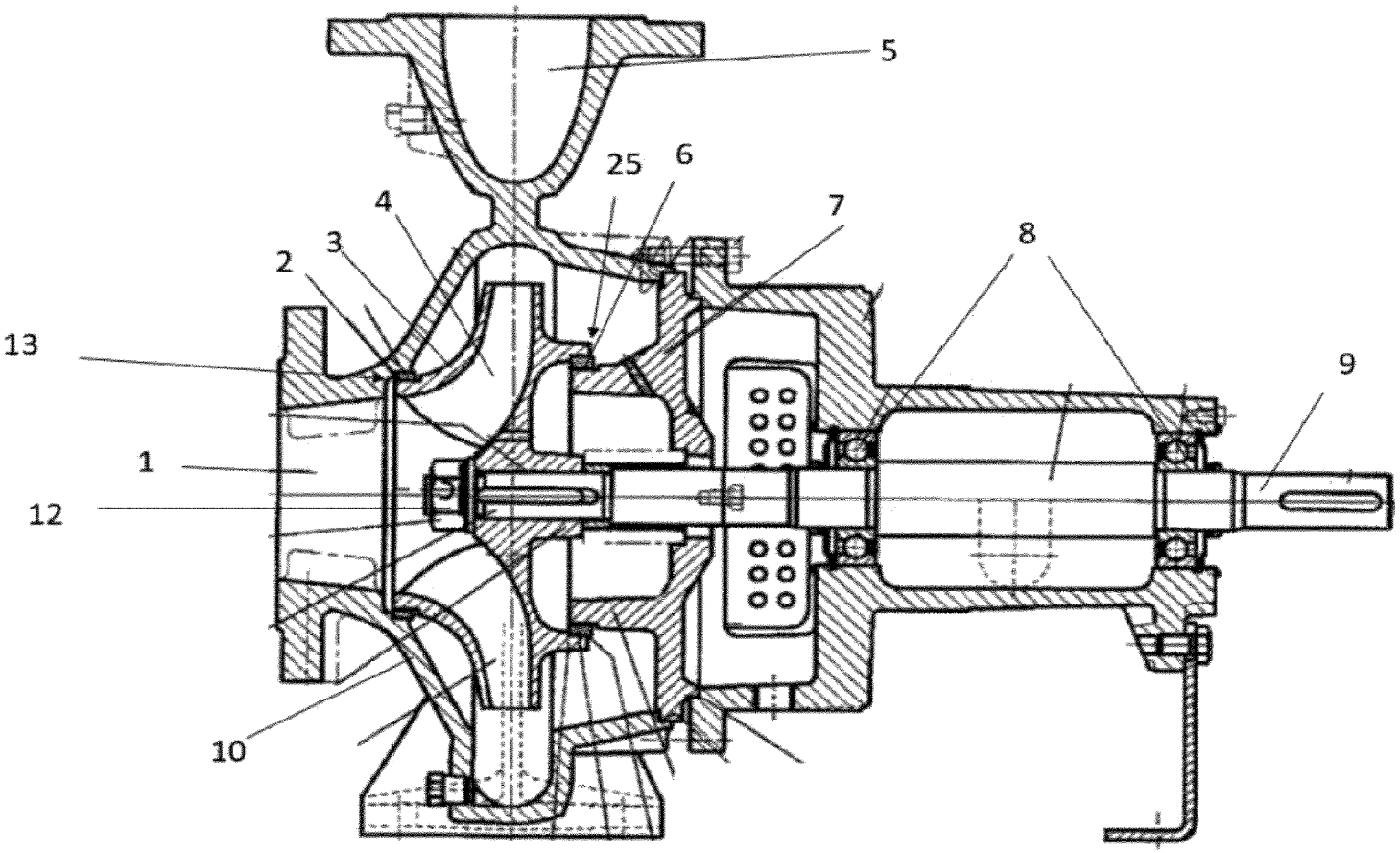
FIG. 1 is a section diagram of a centrifugal pump for conveying of solids-containing medium with a closed impeller in accordance with an embodiment of the present invention.

FIG. 1 shows a section diagram of a centrifugal pump for conveying of solids-containing media with two arrangements for reduction of backflow 13, 25 from a first space into a second space. The arrangements 13, 25 comprise two nonrotating elements 2, 6, which, in this working example, interact with the closed impeller 4. This working example is a spiral housing pump with a horizontal setup. The elements 2 and 6 in this working example are configured as split rings. The solids-containing medium enters the pump via the suction mouth 1, kinetic energy is imparted to it by the closed impeller 4, which is connected to the shaft 9 in a rotationally fixed manner by the mount 12, and it leaves the housing portion 10, in the form of a pump housing in this example, via the pressure port 5. The shaft 9 is mounted rotatably by means of the ball bearing 8. The housing portion 7, in the form of a pressure cap in this working example, closes the pump space in the drive direction. Ideally, elements 2 and 6 are coated with a carbon layer, preferably with an amorphous carbon layer, especially with ta-C. Thus, particularly ideal protection from abrasive wear, which inevitably acts on the split rings in the conveying of solids-containing media, is achieved. Owing to the smooth and extremely hard ta-C coating of the split rings, it is possible to dispense with a ceramic material basis such as silicon carbide. The split rings may be manufactured from a standard cast material or a customary stainless steel material, and are protected by the ta-C coating from the abrasive action of the solids-containing media.

In the region of the suction mouth 1, a fixed, nonrotating element 2, here in the form of a split ring, in the interior of the housing portion 10 is connected to the housing portion 10 by means of a press fit. The element 2 and the impeller 4 are spaced apart from one another, such that a gap is formed between the element 2 and the impeller 4, which functions as a sealing gap with geometrically identical faces.

Figure 2:
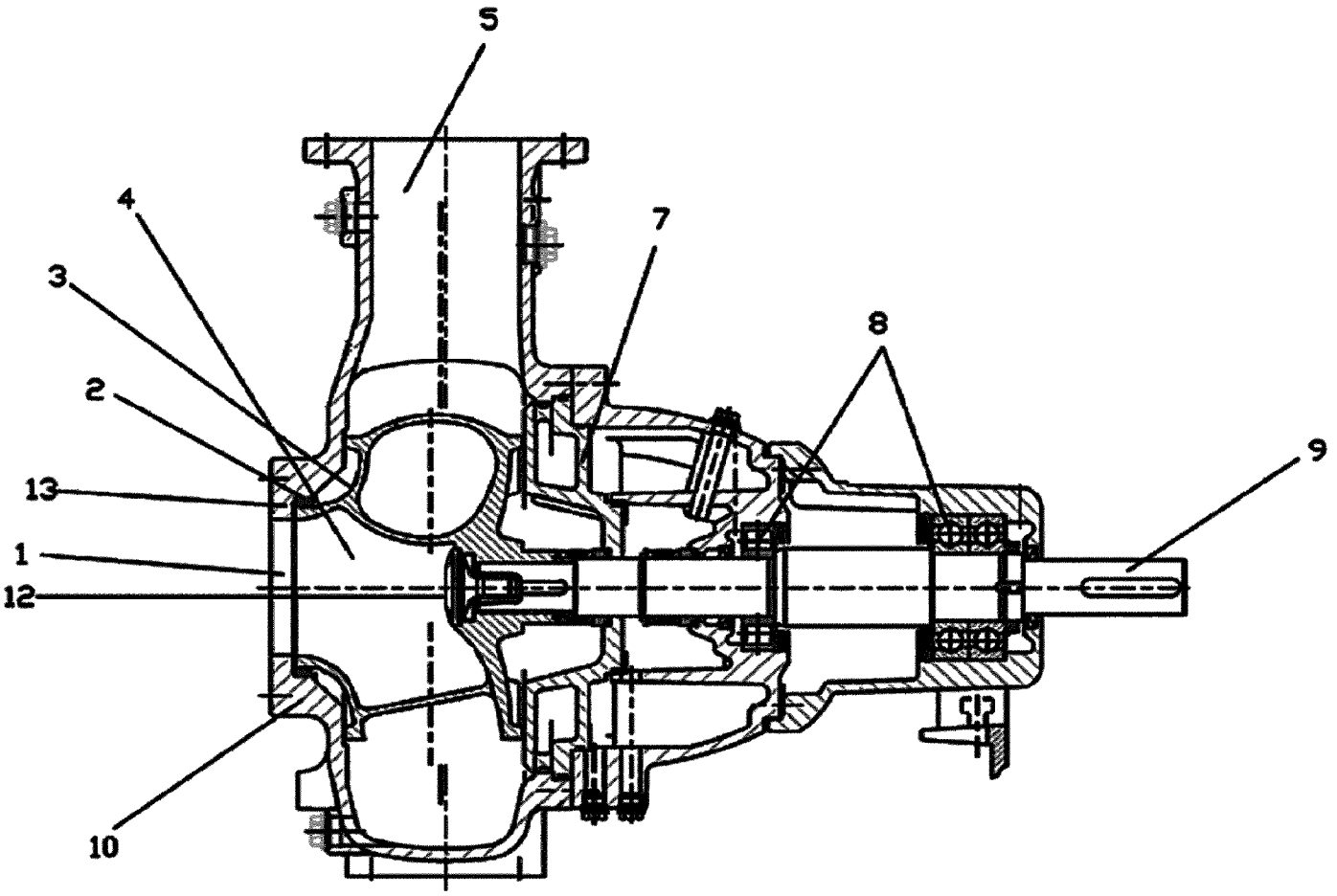
FIG. 2 is a section diagram of a centrifugal pump for conveying of solids-containing medium with a closed single-vane impeller in accordance with an embodiment of the present invention.

FIG. 2 shows a section diagram of a centrifugal pump for conveying of solids-containing media, having a means of reducing backflow 13 from a first space into a second space. The arrangement 13 comprises a fixed, nonrotating element 2, which, in this working example, interacts with the closed single-vane impeller 4. The element 2 takes the form of a split ring in the example. The solids-containing medium enters the pump via the suction mouth 1, kinetic energy is imparted to it by the closed single-vane impeller 4 which is connected to the shaft 9 in a rotationally fixed manner, and it leaves the housing portion 10 via the pressure port 5. The shaft 9 is mounted rotatably by means of the ball bearings 8. The housing portion 7, in the form of a pressure cap in this working example, closes the pump space in the drive direction. According to the invention, the element 2 has been coated with a carbon layer, preferably with an amorphous carbon layer, especially with ta-C. Thus, particularly ideal protection from abrasive wear and also against the encroachment of the closed single-vane impeller toward the split ring is achieved.

Figure 3:
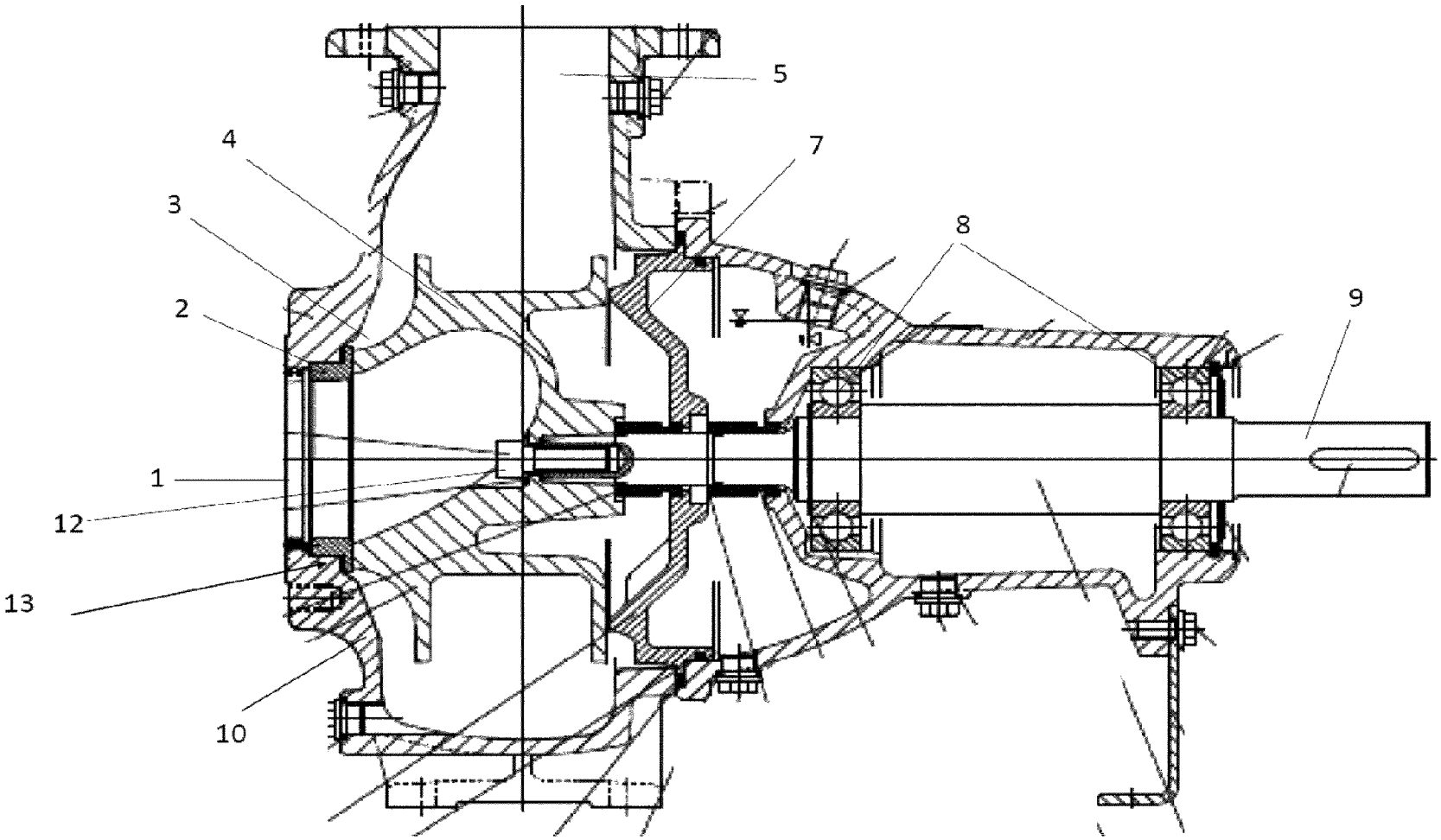
FIG. 3 is a section diagram of a centrifugal pump for conveying of solids-containing media with a closed single-vane impeller in accordance with an embodiment of the present invention.

FIG. 3 shows a section diagram of a centrifugal pump for conveying of solids-containing media, having arrangements for reduction of backflow 13 from a first space into a second space. The arrangement 13 comprises a fixed, nonrotating element 2, which, in this working example, interacts with the closed single-channel impeller 4. The element 2 in this working example takes the form of an L-shaped split ring, the surface of which is coated with ta-C. The solids-containing medium flows into the pump via the suction mouth 1, kinetic energy is imparted to it by the closed single-vane impeller 4 which is connected to the shaft 9 in a rotationally fixed manner, and it leaves the housing portion 10, in the form of a pump housing, via the pressure port 5. The shaft 9 is mounted rotatably by means of the ball bearings 8. The housing portion 7, in the form of a pressure cap in this execution, closes the pump space in the drive direction. According to the invention, the L-shaped element 2, also referred to as angular split ring, is coated with a carbon layer, preferably with an amorphous carbon layer, especially with ta-C. Thus, particularly ideal protection from abrasive wear and also against the encroachment of the closed single-vane impeller 4 toward the split ring is attained.

Figure 4:
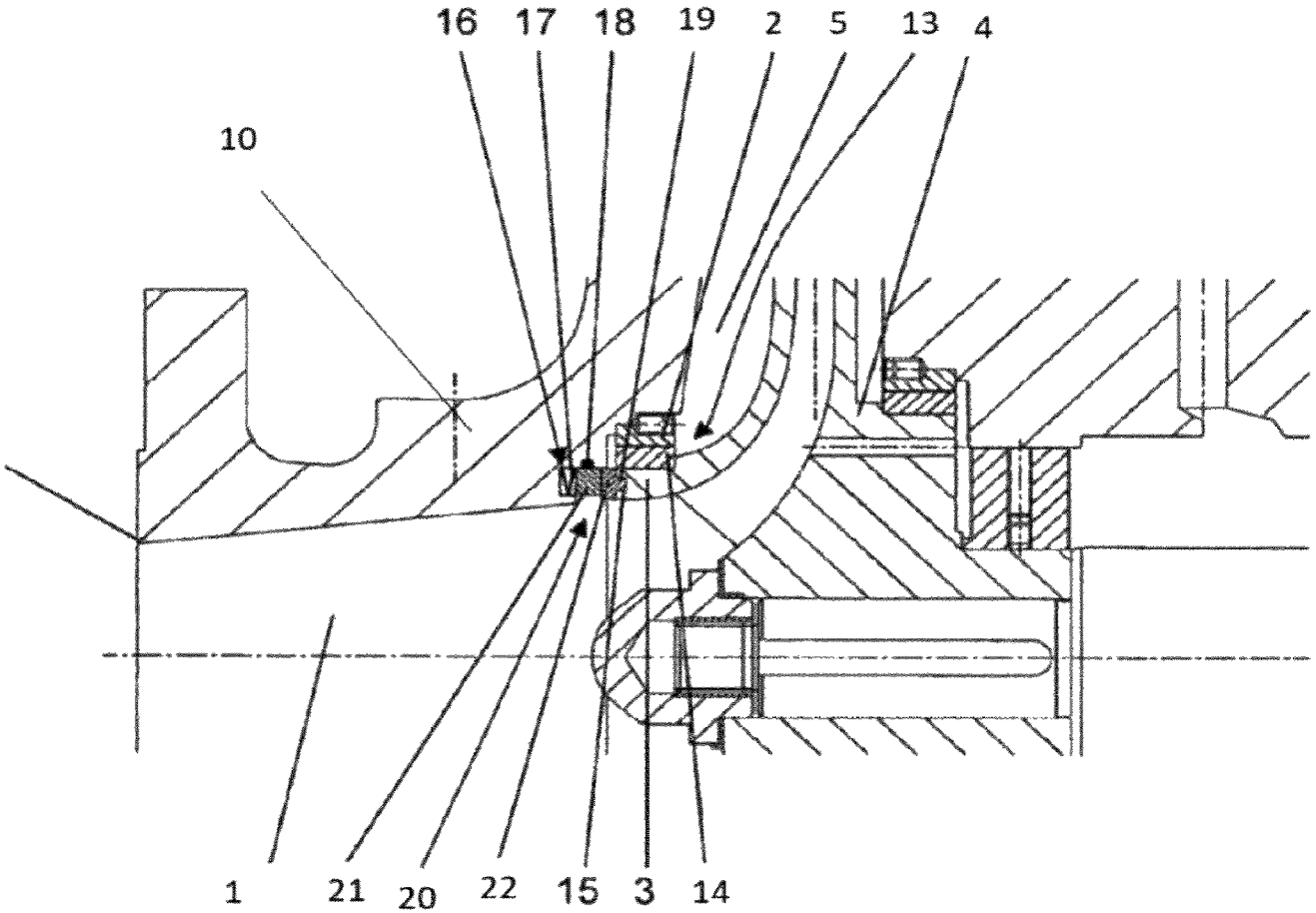
FIG. 4 is a detail enlargement in the region of a suction mouth of the pump in accordance with an embodiment of the present invention.

FIG. 4 shows a detail enlargement in the region of the suction mouth 1 in one variant of the invention. The centrifugal pump has an arrangement for reduction of backflow 13 in the form of a gap seal. This comprises a rotating component 14, in the form of a race, and a nonrotating component 2, in the form of a split ring. The rotating component 14 is disposed on a radial outer face of the cover plate 3 of the impeller 4. The rotating component 14 thus rotates with the impeller 4. The nonrotating component 2 is disposed on the housing portion 10 and has a radial inside of the ring as guide, which interacts with the radial outside of the ring of the rotating component 14, in the form of an angular race in the working example, and forms the gap seal. According to the invention, the element 2 and the rotating component 14 are coated with a carbon layer, preferably with an amorphous carbon layer, especially with ta-C. This achieves particularly ideal protection from abrasive wear.

In the execution according to the diagram in FIG. 4, in addition to an arrangement for reduction of backflow 13, a further arrangement 20 is provided, comprising a rotating element 22 and a nonrotating element 21. The rotating element 22 takes the form of a ring which is disposed at the axial end face of the cover plate 3 and is also referred to as angular race. For this purpose, the rotating element 22 has a projection 19 that extends in axial direction and engages with a groove 15 in the cover plate 3. The nonrotating element 21 takes the form of an axially movable ring which is guided by a face 16 of the housing portion 10 against a radial movement. A force-generating element 17 exerts a force on the nonrotating element 21 and pushes the nonrotating element 21 against the rotating element 22. The force-generating element 17 takes the form of a spring. In the working example, a corrugated spring is used. In an alternative execution of the invention, it is possible to use a sinusoidal spring or a group spring arrangement. The nonrotating element 21 is sealed by the sealing element 18 with respect to the housing portion 10. The sealing element 18 is preferably an O ring.

The rotating element 22 and the nonrotating element 21 in the working example are made from a stainless steel material, coated in accordance with the invention with ta-C. The two mutually axially aligned end faces of the rotating element 22 and of the nonrotating element 21 are pushed against one another by the force-generating element 17. The result is a minimal gap. Friction is minimized by the ta-C coating. A lubricant film of conveying medium is formed in the gap between the faces of the rotating element 22 and of the nonrotating element 21 that are in contact. The arrangement 20 together with the device 13 prevents backflow from a pressure space 5 of the pump into a suction space 1 of the centrifugal pump.

Figure 5:
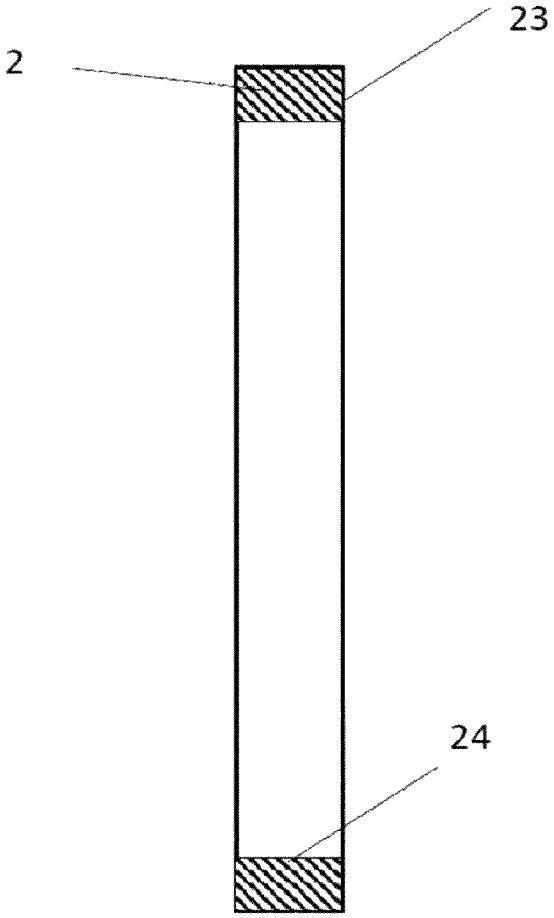
FIG. 5 is a detail section of a fixed, nonrotating element in accordance with an embodiment of the present invention.

FIG. 5 shows a detail section of a nonrotating element 2, coated with a carbon layer at an axial surface 23 and a radial surface 24. The coating with ta-C at at least one split ring end face and at least one inner face of the split ring allows split rings to be manufactured from a standard cast material or a stainless steel material, and ta-C coating allows wear-resistant properties to be obtained.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A centrifugal pump for conveying solids-containing media, comprising:

at least one arrangement configured to reduce backflow from a first space into a second space, the at least one arrangement including at least one nonrotating element that cooperates with at least one rotating counterpart element to minimize backflow, wherein the at least one nonrotating element has a layer of tetrahedral hydrogen-free amorphous carbon, the at least one nonrotating element is a split ring, and the at least one nonrotating element is configured to cooperate with: i) a cover plate of an impeller of the pump, ii) the at least one rotating counterpart element disposed on the cover plate of the impeller of the pump, and iii) an axial surface of the cover plate or a radial surface of the cover plate.

2. The centrifugal pump as claimed in claim 1, wherein the at least one nonrotating element is disposed directly on a housing part of the pump.

3. The centrifugal pump as claimed in claim 1, wherein the at least one nonrotating element has the layer of tetrahedral hydrogen-free amorphous carbon on an axial surface.

4. The centrifugal pump as claimed in claim 1, wherein the at least one nonrotating element has a layer of tetrahedral hydrogen-free amorphous carbon on a radial surface.

5. The centrifugal pump as claimed in claim 4, wherein the at least one nonrotating element has the layer of tetrahedral hydrogen-free amorphous carbon on an axial surface.

6. The centrifugal pump as claimed in claim 5, wherein a thickness of the carbon layer is more than 0.5 μm and less than 18 μm.

7. The centrifugal pump as claimed in any of claim 6, wherein a surface hardness of the carbon layer of the at least one nonrotating element is more than 20 GPa and less than 120 GPa.

8. The centrifugal pump as claimed in any of claim 7, wherein the surface hardness of the carbon layer of the at least one nonrotating element is more than 40 GPa and less than 100 GPa.

9. The centrifugal pump as claimed in claim 5, wherein a thickness of the carbon layer is more than 1.5 μm and less than 14 μm.

10. The centrifugal pump as claimed in claim 1, wherein the at least one rotating counterpart element is a race.

11. The centrifugal pump as claimed in claim 10, wherein the at least one rotating counterpart element at least partly has a layer of carbon.

12. The centrifugal pump as claimed in claim 11, wherein the closed impeller at least partly has the layer of carbon on one or both of the cover plate axial surface and the cover plate radial surface.

13. The centrifugal pump as claimed in claim 1, wherein one or both of the at least one nonrotating element and the at least one rotating counterpart element is formed from a metallic material.

14. The centrifugal pump as claimed in claim 13, wherein the metallic material is a cast material or a stainless steel material.

* * * * *